US009347220B1

(12) United States Patent
Gaydos et al.

(10) Patent No.: US 9,347,220 B1
(45) Date of Patent: May 24, 2016

(54) CEILING SYSTEM

(71) Applicant: ARMSTRONG WORLD INDUSTRIES, INC., Lancaster, PA (US)

(72) Inventors: Christopher David Gaydos, Lititz, PA (US); Brian L. Springer, Lancaster, PA (US)

(73) Assignee: AWI Licensing LLC, Wilmington, DE (US)

( * ) Notice: Subject to any disclaimer, the term of this patent is extended or adjusted under 35 U.S.C. 154(b) by 0 days.

(21) Appl. No.: 14/542,242

(22) Filed: Nov. 14, 2014

(51) Int. Cl.
*E04B 9/04* (2006.01)
*E04B 9/06* (2006.01)
*E04B 9/24* (2006.01)

(52) U.S. Cl.
CPC ..... *E04B 9/045* (2013.01); *E04B 9/0442* (2013.01); *E04B 9/064* (2013.01); *E04B 9/241* (2013.01)

(58) Field of Classification Search
CPC ..... E04B 9/24; E04B 9/241; E04B 9/245; E04B 9/26; E04B 9/28; E04B 9/0442; E04B 9/064; E04B 9/045
USPC ..... 52/506.01, 506.06, 506.07, 506.08, 52/506.09, 506.1, 783.1
See application file for complete search history.

(56) References Cited

U.S. PATENT DOCUMENTS 2,066,255 A * 12/1936 Dempsey ..... 52/506.08
3,032,833 A * 5/1962 Stanley ..... 52/506.07
3,380,206 A * 4/1968 Barnett ..... 52/145
3,513,613 A 5/1970 Jones et al.
3,969,865 A * 7/1976 Andersen ..... 52/506.07
4,026,081 A * 5/1977 Delaney et al. ..... 52/222
4,155,206 A * 5/1979 Player ..... 52/200
4,640,064 A * 2/1987 Goodworth, II ..... 52/506.08
4,991,370 A * 2/1991 Gailey et al. ..... 52/506.1
5,182,893 A * 2/1993 Goodworth ..... 52/745.05
5,313,759 A * 5/1994 Chase, III ..... E04B 9/02 52/39
5,401,133 A * 3/1995 Kuchler ..... 411/402
5,507,125 A * 4/1996 McClure ..... 52/506.07

(Continued)

FOREIGN PATENT DOCUMENTS

EP 1489241 12/2004
FR 2214800 8/1974

(Continued)

OTHER PUBLICATIONS

Partial International Search Report for corresponding Application No. PCT/US2015/060676, mailed Feb. 18, 2016.

*Primary Examiner* — Joshua J Michener
*Assistant Examiner* — Theodore Adamos
(74) *Attorney, Agent, or Firm* — Craig M. Sterner

(57) ABSTRACT

A ceiling system in one embodiment includes a grid support member including a flange defining a bottom surface and a ceiling panel supported by the grid support member. A first facing sheet includes a peripheral edge portion attached to the grid support member. An integral cutting guide groove is formed in the bottom surface of the grid support member. The peripheral edge portion of first facing sheet includes an edge which is axially aligned with the groove. A second ceiling panel includes a second facing sheet including a peripheral edge portion having an edge axially aligned with the groove and disposed adjacent the edge of the first facing sheet to form a seam. The first and second facing sheets conceal the grid support member. A related method of installation is disclosed.

18 Claims, 8 Drawing Sheets

(56) References Cited

U.S. PATENT DOCUMENTS

| | | | | |
|---|---|---|---|---|
| 5,609,007 | A | 3/1997 | Eichner | |
| 6,145,264 | A * | 11/2000 | Dallaire | 52/506.07 |
| 6,305,137 | B1 | 10/2001 | Rebman | |
| 6,467,228 | B1 * | 10/2002 | Wendt et al. | 52/506.07 |
| 7,765,762 | B2 * | 8/2010 | Gulbrandsen et al. | 52/506.09 |
| 7,937,903 | B2 * | 5/2011 | McGee et al. | 52/506.09 |
| 2002/0014051 | A1 * | 2/2002 | Fraval et al. | 52/794.1 |
| 2003/0145547 | A1 * | 8/2003 | Kliegle et al. | 52/506.07 |
| 2003/0154686 | A1 * | 8/2003 | Platt | 52/733.1 |
| 2004/0055239 | A1 | 3/2004 | Hang | |
| 2005/0217194 | A1 * | 10/2005 | Krantz-Lilienthal et al. | 52/506.06 |
| 2007/0193131 | A1 * | 8/2007 | Ortiz | 52/144 |
| 2008/0155927 | A1 * | 7/2008 | Wendt et al. | 52/506.07 |
| 2009/0173030 | A1 * | 7/2009 | Gulbrandsen et al. | 52/506.09 |
| 2010/0139189 | A1 * | 6/2010 | LaLonde | 52/220.6 |
| 2012/0137615 | A1 * | 6/2012 | Wendt | 52/506.07 |

FOREIGN PATENT DOCUMENTS

| | | | | |
|---|---|---|---|---|
| GB | 2152091 | A * | 7/1985 | E04B 9/008 |
| NL | 1034759 | | 5/2009 | |
| WO | 2005/59267 | | 6/2005 | |

* cited by examiner

CEILING SYSTEM

FIELD

The present invention relates to suspended ceiling systems with concealed support grids.

BACKGROUND

Numerous types of suspended ceiling systems and methods for mounting ceiling panels have been used. One type of system includes a suspended support grid including an array of intersecting grid support members configured to hang a plurality of individual ceiling panels therefrom. It is desirable in some cases to conceal the support grid for providing the appearance of a monolithic ceiling.

SUMMARY

A ceiling system is provided which conceals the ceiling support grid with adjoining facings or scrims between adjacent ceiling panels. The ceiling system includes grid support members having an integral cutting guide groove to permit tight and straight seams to be made between the facings.

In one embodiment, a ceiling system includes a longitudinally extending grid support member including a longitudinal axis and a bottom flange defining a bottom surface, and a ceiling panel supported by the grid support member. A first facing sheet having a peripheral edge portion is attached to the grid support member. An integral cutting guide groove is formed in the bottom surface of the grid support member, the groove extending linearly along the longitudinal axis. The peripheral edge portion of first facing sheet includes an edge which is axially aligned with the groove. In some embodiments, a second facing sheet of a second ceiling panel is supported by the grid support member. The second facing sheet has an edge which is axially aligned with the groove and disposed adjacent the edge of the first facing sheet. The first and second facing sheets conceal the grid support member.

In another embodiment, a ceiling system includes a first grid support member and second grid support member spaced apart from the first grid support member. Each of the first and second grid support members includes a longitudinal axis, a bottom flange defining a bottom surface, a vertical web extending upwards from the bottom flange, and an integral cutting guide groove formed in the bottom surface and extending linearly along the longitudinal axis. A ceiling panel extends between the first and second grid support members. The ceiling panel is supported by the first and second grid support members. A first facing sheet is disposed below the ceiling panel and attached to the first and second grid support members. The first facing sheet includes a first edge which is axially aligned with the groove of the first grid support member and an opposing second edge which is axially aligned with the groove of the second grid support member.

A method for concealing a grid support member of a ceiling system is provided. The method includes the following steps: providing a grid support member including a longitudinal axis and cutting guide groove formed in a bottom surface; positioning a first ceiling panel on the grid support member, the first ceiling panel including a bottom facing sheet having a peripheral edge portion; laterally positioning the peripheral edge portion of the first ceiling panel beneath the grid support member by a distance sufficient to extend across the cutting guide groove; positioning a second ceiling panel on the grid support member, the second ceiling panel including a bottom facing sheet having a peripheral edge portion; laterally positioning the peripheral edge portion of the second ceiling panel beneath the grid support member by a distance sufficient to extend across the cutting guide groove, the peripheral edge portion of the second ceiling panel overlapping the peripheral edge portion of the first ceiling panel; running a blade of a cutting tool along the grid support member in the cutting guide groove and through the overlapping peripheral edge portions of the first and second ceiling panels; and trimming the overlapping peripheral edge portions of the first and second ceiling panel to form an abutment seam. The grid support member is concealed by the overlapping peripheral edge portions of the bottom facing sheets of the first and second ceiling panels.

BRIEF DESCRIPTION OF THE DRAWINGS

The features of the exemplary embodiments of the present invention will be described with reference to the following drawings, where like elements are labeled similarly, and in which.

Figure 1:
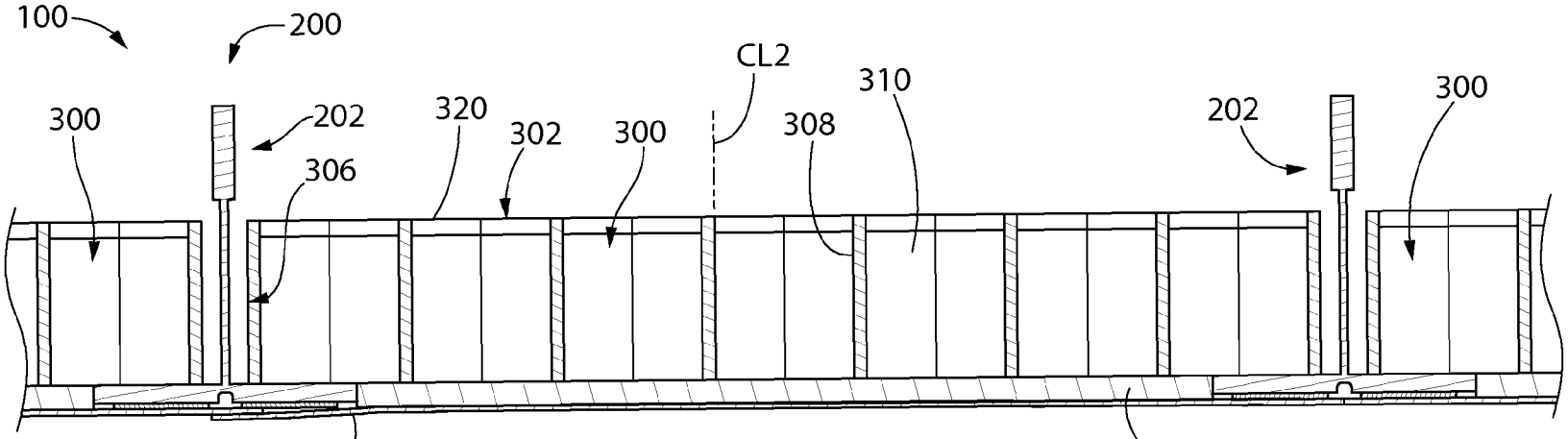
FIG. 1 is a side elevation cross-sectional view of a ceiling system comprising grid support members and ceiling panels.

All drawings are schematic and not necessarily to scale. Parts given a reference numerical designation in one figure may be considered to be the same parts where they appear in other figures without a numerical designation for brevity unless specifically labeled with a different part number and described herein.

DETAILED DESCRIPTION

The features and benefits of the invention are illustrated and described herein by reference to exemplary embodiments. This description of exemplary embodiments is intended to be read in connection with the accompanying drawings, which are to be considered part of the entire written description. Accordingly, the disclosure expressly should not be limited to such exemplary embodiments illustrating some possible non-limiting combination of features that may exist alone or in other combinations of features.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed,"

"connected," "coupled," "interconnected," and similar refer to a relationship wherein structures are secured or attached to one another either directly or indirectly through intervening structures, as well as both movable or rigid attachments or relationships, unless expressly described otherwise.

FIG. 1 depicts an exemplary embodiment of a ceiling system 100 according to the present disclosure. The ceiling system 100 includes an overhead support grid 200 including a plurality of overhead longitudinal grid support members 202 and ceiling panels 300 supported by the grid support members. The grid support members 202 are mountable in a suspended manner from an overhead building support structure.

Figure 4:
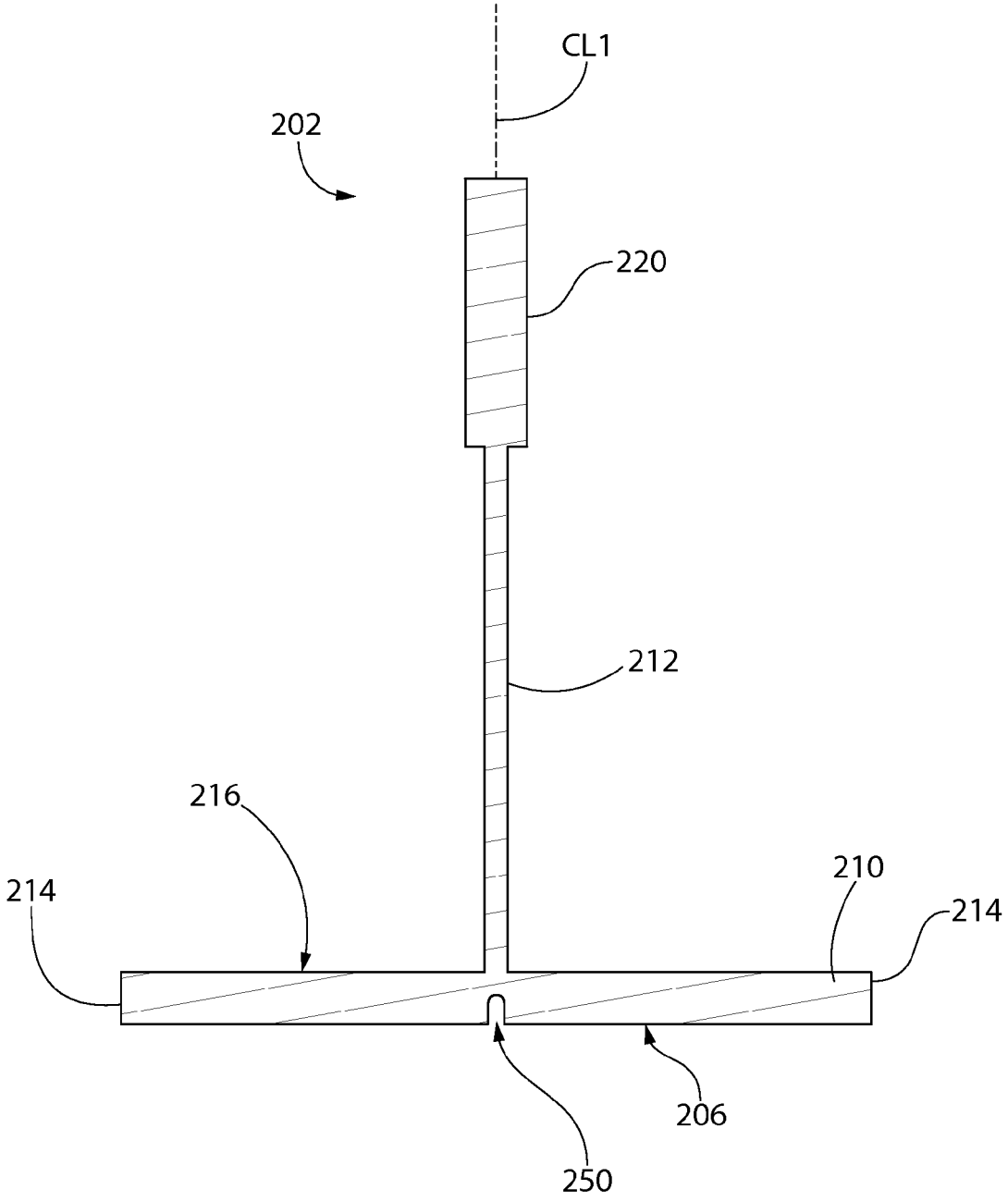
FIG. 4 is an enlarged front elevation cross-sectional view of the grid support member.
Figure 5:
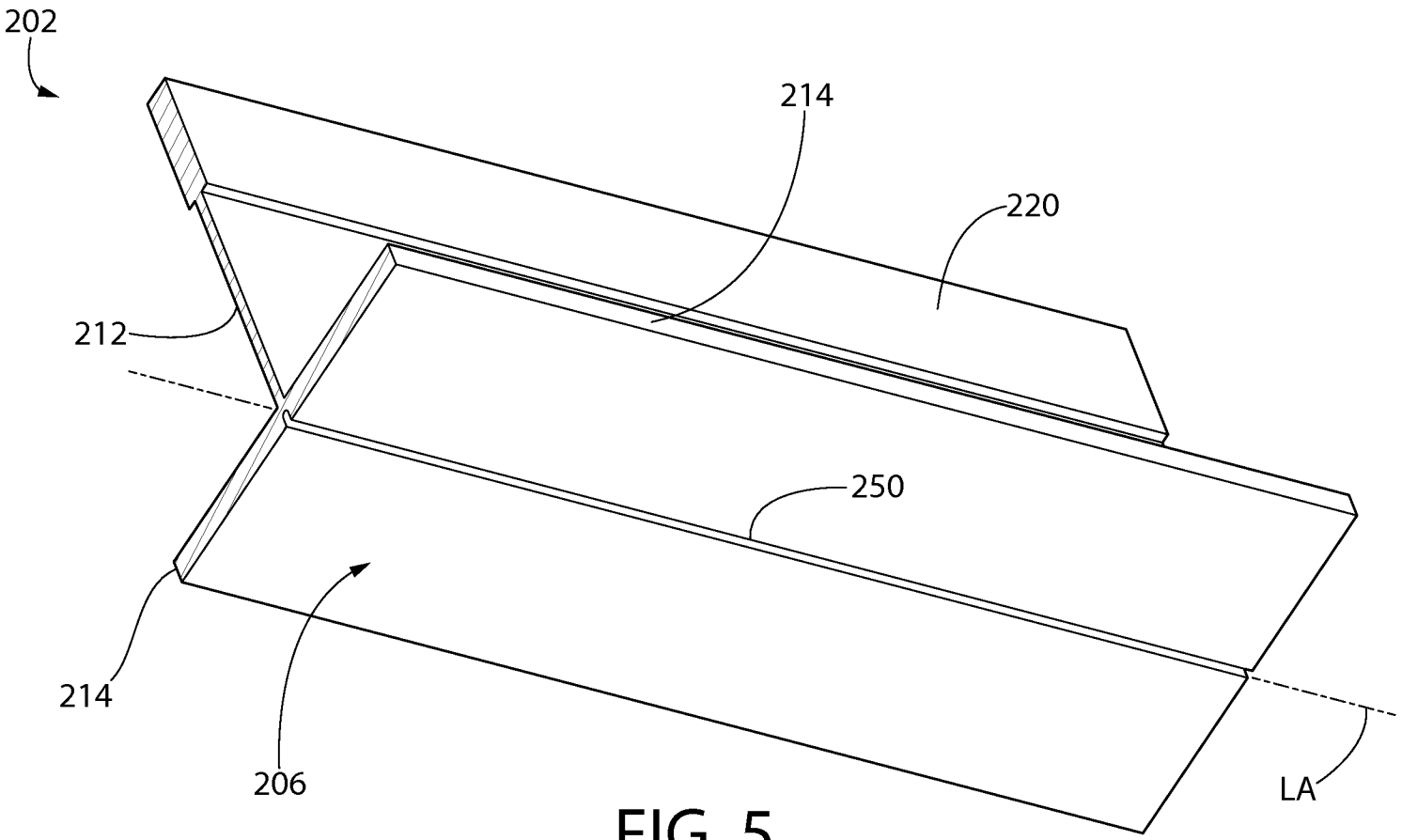
FIG. 5 is a cross-sectional bottom perspective view thereof.

Referring to FIGS. 1, 4, and 5, grid support members 202 are elongated in shape having a length greater than their width (e.g. at least twice), and in various embodiments lengths substantially greater than their widths (e.g. 3 times or more). The grid support members 202 may form "runners" or "rails" and are laterally spaced apart and oriented parallel to each other as shown in FIG. 1 to position a ceiling panel 300 therebetween. In some embodiments, the longitudinal grid support members 202 may be maintained in a substantially parallel spaced apart relationship to each other by lateral grid support members (not shown) attached between adjacent (but spaced apart) grid support members 202 at appropriate intervals using any suitable permanent or detachable manner of coupling.

In one embodiment, grid support members 202 may be horizontally oriented when installed. It will be appreciated, however, that other suitable mounted orientations of grid support members 202 such as angled or sloped (i.e. between 0 and 90 degrees to horizontal) may be used. Accordingly, although support members 202 may be described in one exemplary orientation herein as horizontal, the invention is not limited to this orientation alone and other orientations may be used.

With continuing reference to FIGS. 1, 4, and 5, grid support members 202 may be T-shaped (e.g. T-rails) in transverse cross section. The grid support members have an inverted T-shaped configuration when in an installed position suspended from an overhead building ceiling support structure. The grid support members 202 may be suspended from the building ceiling support structure via an appropriate hanger mechanism, such as for example without limitation fasteners, hangers, wires, cables, rods, struts, etc.

Grid support members 202 may each include a longitudinally-extending horizontal bottom flange 210, an enlarged top stiffening channel 220, and a vertical web 212 extending upwards from the flange to the stiffening channel. In some embodiments, the top stiffening channel 220 may be omitted. The grid support members 202 each define a respective longitudinal axis LA and axial directions. Bottom flange 210 has opposing portions which extend laterally outwards from web 212 and terminate in opposed longitudinally extending edges 214. Web 212 may be centered between the edges 214 and vertically aligned with the centerline CL1 of the grid support member in one non-limiting embodiment. In other embodiments, the web 212 may be laterally offset from centerline CL1. Bottom flange 210 further defines a bottom surface 206 facing downwards away from the flange and towards a room or space below the support grid 200. Bottom surface 206 defines a horizontal ceiling reference plane for the overhead support grid 200. Flange 210 further defines a top surface 216 for positioning and supporting the ceiling panel 300 thereon.

Grid support members 202 may be made of any suitable metallic or non-metallic materials structured to support the dead weight or load of ceiling panels 300 without undue deflection. In some non-limiting embodiments, the grid support members may be made of metal including aluminum, titanium, steel, or other. In one embodiment, the grid support members 202 may be a standard heavy duty 15/16 inch aluminum T-rail.

Figure 2:
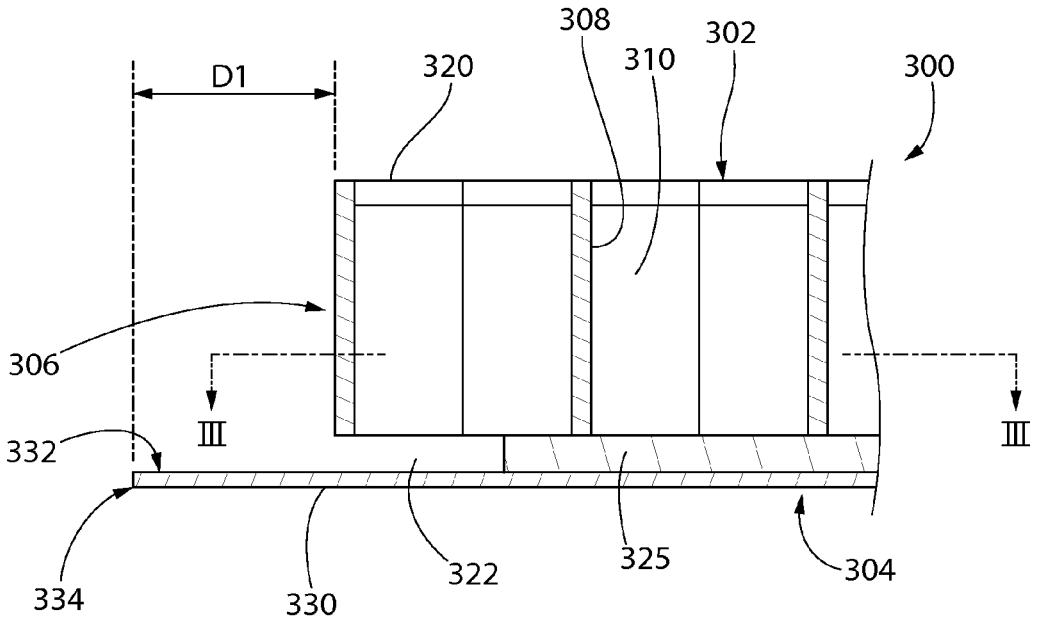
FIG. 2 is an enlarged side elevation cross-sectional view of a peripheral side or end portion of the ceiling panel.
Figure 3:
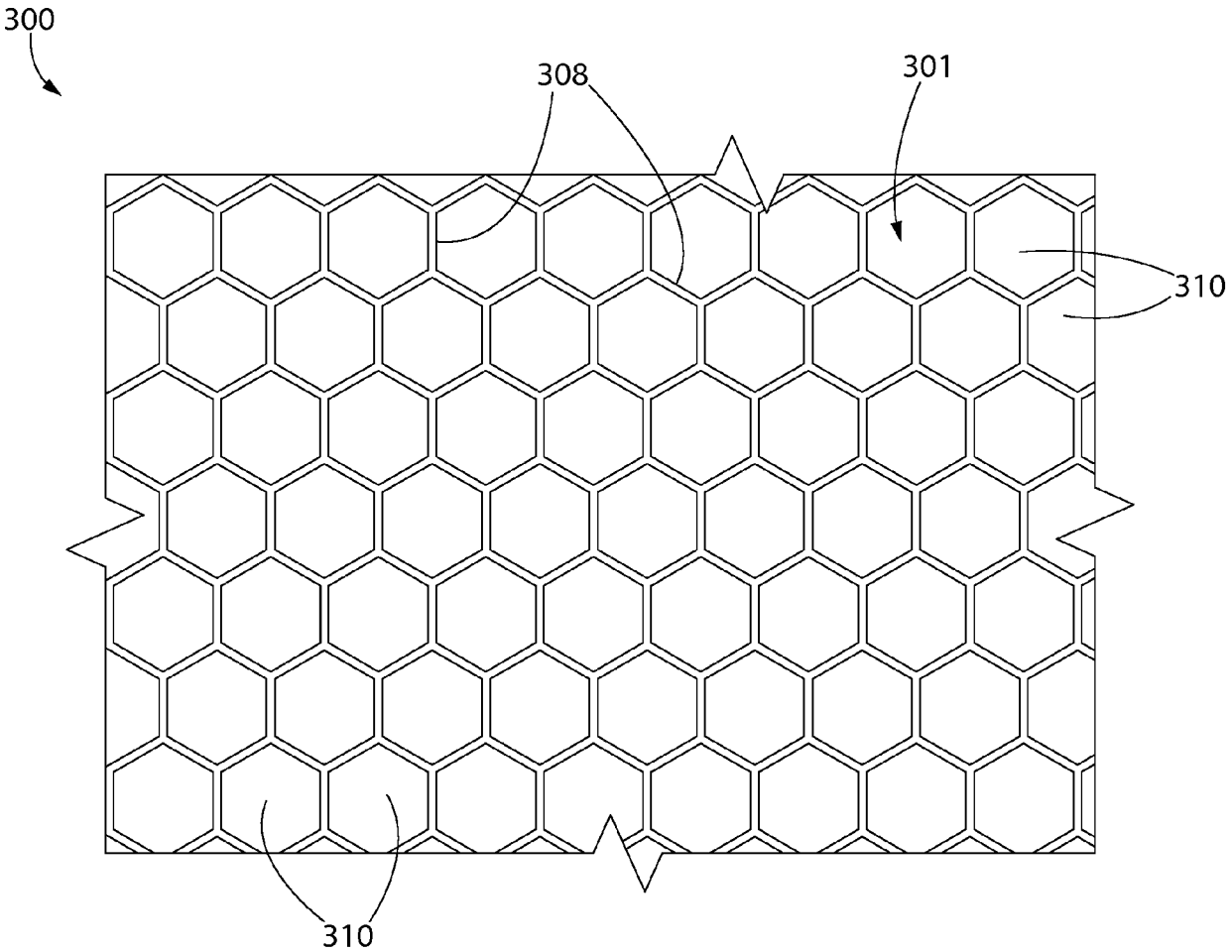
FIG. 3 is a transverse cross-section of the ceiling panel taken along line 3-3 in FIG. 2 and showing one embodiment of a core structure of the ceiling panel.

Referring now FIGS. 1-3, ceiling panel 300 may have a generally flattened body with a substantially greater horizontal width and length than vertical thickness as shown. Ceiling panel 300 includes a top surface 302, bottom surface 304, and lateral sides 306 extending therebetween along four sides of the panel. Sides 306 define peripheral surfaces which may be oriented substantially parallel to the vertical centerline CL2 of the ceiling panel 300. In some embodiments, the peripheral surfaces may be angled or sloped, or have a stepped edge profile or configuration. Top and bottom surfaces 302, 304 may be generally planar and arranged substantially parallel to each other in one non-limiting embodiment.

Ceiling panels 300 may be constructed of any suitable material including without limitation mineral fiber board, fiberglass, jute fiber, metals, polymers, wood, composites, resin impregnated kraft paper, or other. In addition, the ceiling panels 300 may have any suitable dimensions and shapes (in top plan view) including without limitation square or rectangular.

In one embodiment, ceiling panels 300 may have an inner core 301 comprising a honeycomb structure formed from a plurality of interconnected cell walls 308 that define a plurality of open cells 310 (best shown in FIG. 3). The cell walls 308 are oriented perpendicular to the top and bottom surfaces 302, 304 of the ceiling panels 300 and extend vertically between the top and bottom surfaces. Any suitable shape of cells 310 (in top plan view) may be used, including hexagon, triangular, square, circular, etc. as some non-limiting examples.

In one embodiment, the core 301 may be formed by paper cell walls 308. Paper used to construct cell walls 308 may be at least 20 pound kraft paper, and in some embodiments 20 to 80 pound kraft paper (thicknesses of about 0.004 to 0.015 inches) which generally provides the requisite stiffness to the core to resist sagging of the ceiling panel without unduly adding weight to the ceiling panel structure. As opposed to other materials, paper is generally more economical and cost-effective as a core wall material. The paper may be resin-impregnated in some embodiments. In other possible embodiments, lightweight non-paper material such as fiberglass and thin aluminum metal sheet also may perform satisfactorily for cell walls and be used. Non-woven materials, such as for example without limitation non-woven glass fibers in a resin matrix, may also be used.

With continuing reference to FIGS. 1-3, ceiling panel 300 further includes a top facing sheet 320 and bottom facing sheet 330. The facing sheets 320, 330 may be directly or indirectly coupled to the core 310 thereby forming part of the ceiling panel structure. The facing sheets 320, 330 may be permanently bonded to core 301 using a suitable industrial adhesive 35 which is applied to the exposed upper and lower edges of the core cell walls 308, thereby closing the upper and lower ends of the cells 310. Industrial adhesives which may be used include Swift®tak from H.B. Fuller Company and others. The combination of core 301 and the top and bottom facing sheets 320, 330 collectively form a relatively rigid composite structure which resists sagging when installed in the support grid 200.

In some embodiments, the bottom facing layer 330 may be in the form of a scrim comprised of laminated non-woven glass fibers in a resin matrix. This type construction is suitable for high end acoustical panels to impart a smooth visual appearance, durability, and dimensional stability. Other suitable scrim materials may be used for both the top and bottom facing sheets 320, 330 and are available from suppliers such as Owens Corning, Lydall, Ahlstrom and Johns Manville. Such materials may include films, sheets, woven materials and open cell foamed materials are all suitable Ceiling panel 300 may further include a spacer panel 325 in some embodiments as shown in FIGS. 1 and 2. Bottom facing sheet 330 is permanently attached to the spacer panel 325, which in turn is permanently attached to the bottom of ceiling panel 300. In some embodiments, the attachment may be made via a suitable industrial adhesive (e.g. Swift®tak adhesive from H.B. Fuller Company and others). Spacer panel 325 may be in the form of a substantially flat sheet of material having a thickness (measured vertically) sufficient to make up and fill the vertical gap between the bottom of ceiling panel core 301 and bottom surface 206 of grid support member 202, as best shown in FIG. 1 (which substantially equates to the thickness of the flange 210). This locates the bottom facing sheet 330 in a vertical position that is substantially flush with the bottom surface 206 on the grid support member bottom flange 210. Spacer panel 325 has a horizontal width dimensioned to fit and extend between opposed edges 214 of a pair of grid support members 300 (see, e.g. FIG. 1). When a ceiling panel 300 having a honeycomb core 301 is used, the spacer panel 325 may provide a convenient and cost-effective means to fill the gap between the grid support member flanges 210 rather than cutting of the open-celled honeycomb core to form a stepped side edge profile at the sides of the ceiling panel. In addition to a cut or pressed edge, non-wovens, polymer frames or panels, foamed materials or other fibrous or non-fibrous materials may be used.

Figure 10:
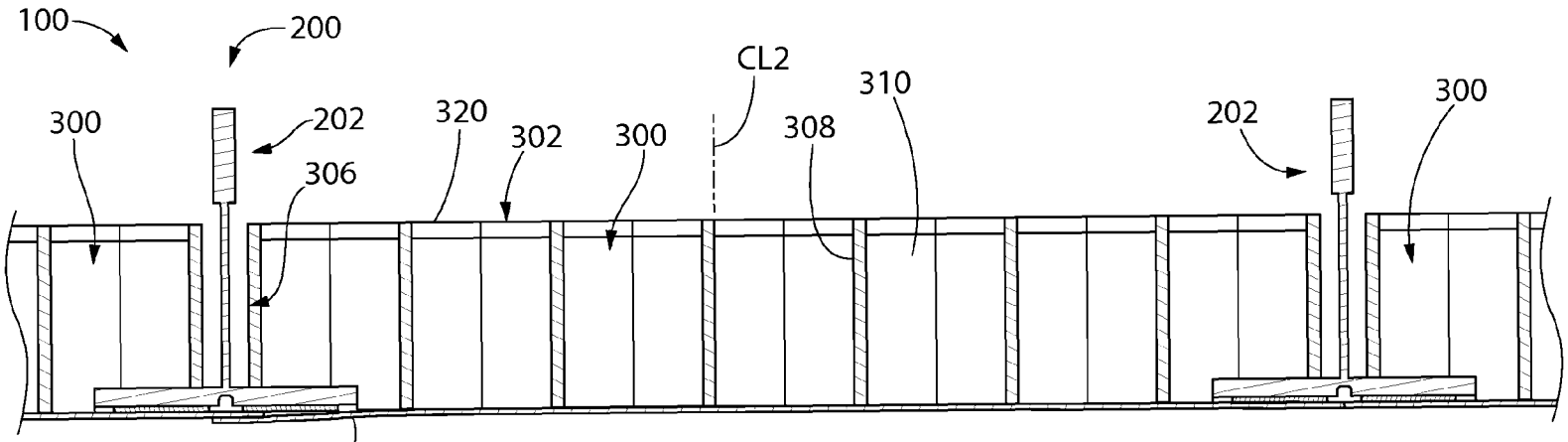
FIG. 10 is a side elevation cross-sectional view of the ceiling system showing an alternative construction of the ceiling panel.

In alternative embodiments as shown in FIG. 10, the ceiling panel 300 however may have a sufficient vertical thickness between the sides 306 and an integral stepped side edge profile or configuration (in transverse cross section) so that the bottom facing sheet 330 is in a vertical position that is substantially flush with the bottom surface 206 on the grid support member bottom flange 210 without the need for a spacer panel 325. This construction may be convenient particularly with non-honeycomb core ceiling panels.

Either construction of FIG. 1 or 10 essentially forms a tegular ceiling panel 300 having a stepped side edge profile (see also FIG. 2) so that the ceiling panel may be seated on and supported by the top surface 216 of the grid support member's bottom flange 210. This stepped edge profile also helps to properly horizontally position and secure the ceiling panels 300 between the grid support members 202.

Referring to FIGS. 1 and 2, the bottom facing sheet 330 in one embodiment has an extension that projects or extends laterally in a horizontal direction beyond the sides 306 of the ceiling panel 300 by a distance D1. Accordingly, bottom facing sheet 330 has a horizontal width that is larger than the horizontal width of the ceiling panel core 301 measured between opposite lateral sides 306. This creates free or cantilevered peripheral edge portions 332 that allow the bottom facing sheet 330 to extend underneath and at least partially across the face or bottom surface 206 of the grid support member 202 for concealing the support grid, as further described herein. A peripheral slot 322 is formed between the ceiling panel core 301 and bottom facing sheet 310 that extends horizontally along at least two sides 306 of the ceiling panel as shown in FIG. 1. The slot 322 allows insertion of the grid support member bottom flange 210 therein when mounting the ceiling panel 300 to the grid support members 202.

In one embodiment with reference to FIGS. 4 and 5, a linear cutting guide groove 250 is provided to facilitate neatly trimming adjacent bottom facing sheets 330 of two ceiling panels 300 to conceal the grid support member 202 from building occupants for creating a monolithic ceiling appearance. Groove 250 is formed in bottom surface 206 of the grid support member 202. The groove 250 extends linearly in an axial direction along and parallel to the longitudinal axis of the grid support member 202. In one embodiment, the groove 250 may be vertically aligned with the web 212 and centerline CL1 of the grid support member 202, thereby centering the groove between the longitudinally extending edges 214 of flange 210. The cutting guide groove 250 has a depth which is less than the vertical thickness of the grid support member flange 210. The depth need only be sufficient to engage a cutting tool which may be slid along the length of the groove 250 for trimming the facings 330, as further described herein.

A method for concealing a grid support member 202 of a ceiling system 100 will now be described. FIGS. 6-9 illustrate sequential steps in the process.

Figure 6:
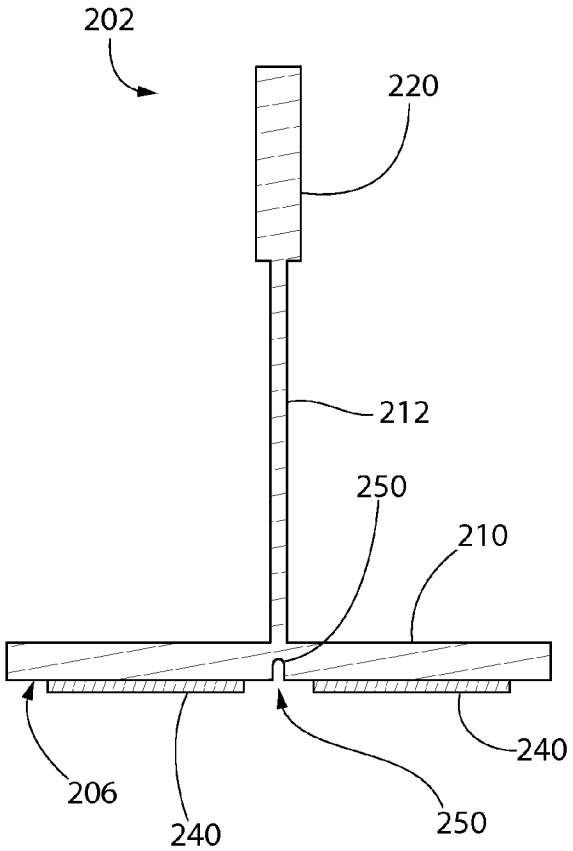

Referring to FIG. 6, a grid support member 202 is provided which may be hung from an overhead ceiling support structure. The grid support member 202 includes cutting guide groove 250 formed in the downward facing bottom surface 206 as described herein. For securing the bottom facing sheet 330 to the grid support member 202, a pair of longitudinally-extending adhesive strips 240 may be provided on the bottom surface 206 of the grid support member. The strips 240 extend axially along and parallel to the longitudinal axis of the grid support member 202. The adhesive strips 240 may have a length that extends for substantially the entire portion of the grid support member to which the bottom facing sheets 330 will come into contact when the ceiling panel 300 is mounted. In one embodiment, a continuous length of adhesive strip 240 may be used for this purpose. In alternative embodiments, however, intermittent gaps may be formed between multiple pieces of adhesive strips 240.

The adhesive strips 240 are placed laterally adjacent and proximate to the cutting guide groove 250 on both sides to form a neat seam between peripheral edges 334 of adjacent bottom facing sheets 330 beneath the grid support member 202. The adhesive strips may be suitably strong double-side tape having two tacky sides—one for attachment to the grid support member and the other for attachment to the bottom facing sheet 330. In some embodiments, a releasable type adhesive may be used to allow the ceiling panels 300 and facing sheets to be cleanly removed and replaced if temporary access is needed to utilities above the ceiling system 100. In alternative embodiments, a spray adhesive may be used instead which is applied to the bottom surface 206 of the grid support member 202 to form two longitudinally extending strips of adhesive. The spray adhesive may be a releasable type in some embodiments. In yet other possible embodiments, a hook and loop releasable fastening element such as Velcro® strips may be used in which one piece is attached to the grid support member 202 and the other piece is attached to the upper surface of the peripheral edge portion 332 of the ceiling panel bottom facing sheet 330. Activated adhesives such as hot melt film could also be used for attachment to grid support member—pre-attached to grid and activated in field with hot element (i.e. iron) for example. Mechanical methods or magnets could also be used.

Figure 7:
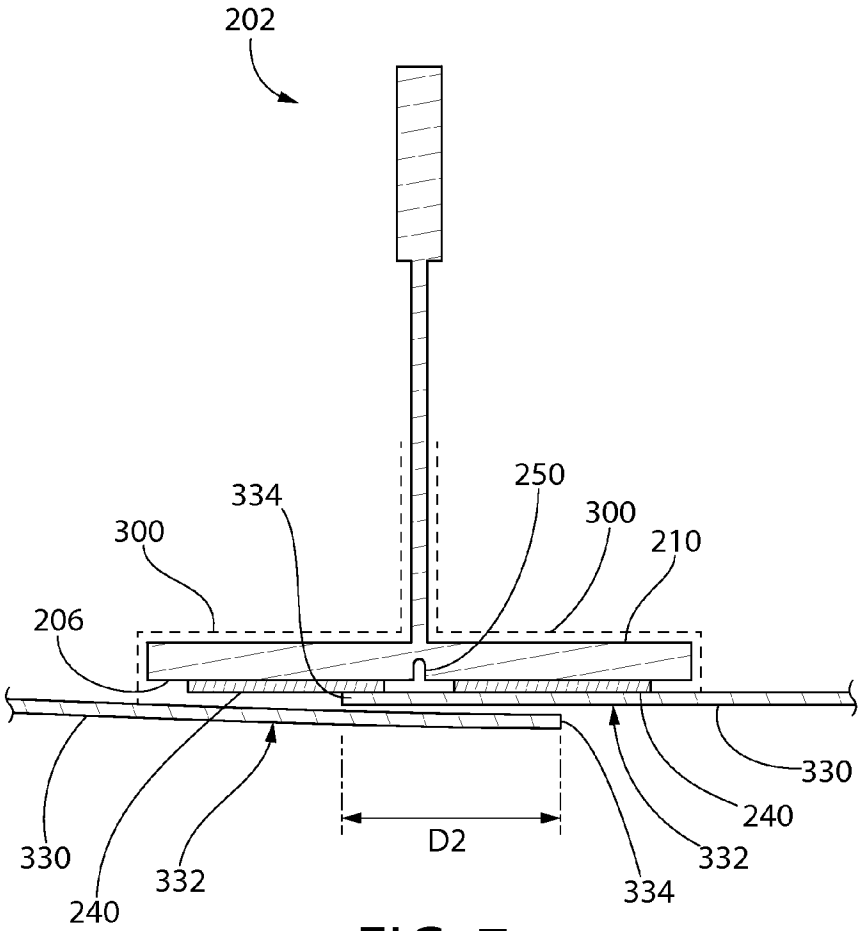
FIGS. 6-9 show front elevation cross-sectional views of a grid support member and ceiling panels illustrating sequential steps in a method for installing the ceiling system of FIG. 1 to conceal the grid support member.

Referring to FIG. 7, a first ceiling panel 300 (e.g. the right panel shown in dashed lines for clarity) is installed on one side of the grid support member 202. The peripheral edge portion 332 of the bottom facing sheet 330 is laterally inserted and positioned beneath the bottom surface 206 of the bottom flange 210 by a sufficient distance that extends across and over the cutting guide groove 250. This locates the peripheral edge 334 defined by the peripheral edge portion 332 of the bottom facing sheet 330 on the opposite (e.g. left) side of the cutting guide groove 250. The free or cantilevered peripheral edge portion 332 provides sufficient flexibility to allow the bottom facing sheet 330 to deflect slightly to accomplish this placement. During the placement, the peripheral edge portion 332 may be pressed upwards against the exposed tacky side of the near side adhesive strip 240 for attachment after the edge portion is properly positioned.

In a similar manner, a second ceiling panel 300 (e.g. the left panel shown in dashed lines for clarity) is next installed on the opposite side of the grid support member 202. The peripheral edge portion 332 of the bottom facing sheet 330 is laterally inserted and positioned beneath the bottom surface 206 of the bottom flange 210 by a sufficient distance that extends across and over the cutting guide groove 250. This locates the peripheral edge 334 of the bottom facing sheet 330 of the second ceiling panel 300 on the opposite side (e.g. right) of the cutting guide groove 250. The peripheral edge portion 334 of the second ceiling panel preferably overlaps the peripheral edge portion 334 of the first ceiling panel 300 by a distance D2 (see FIG. 7).

Figure 9:
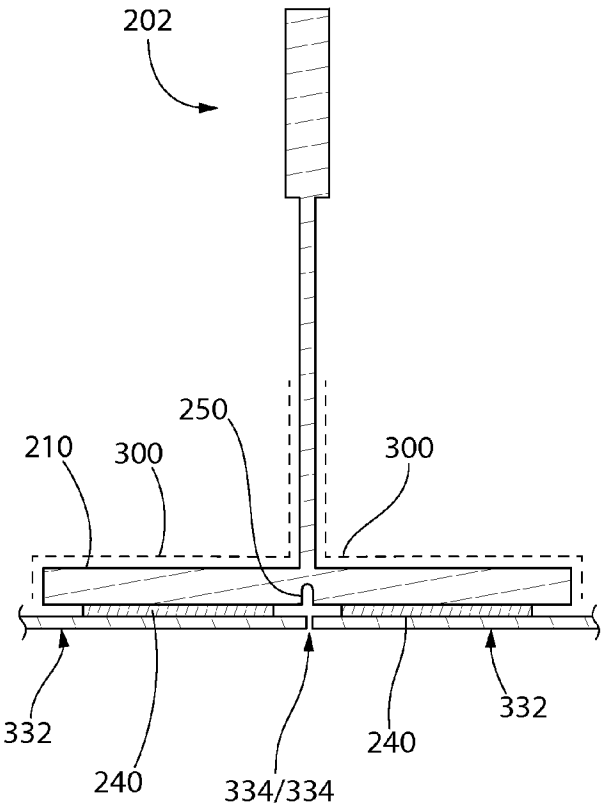
Figure 8:
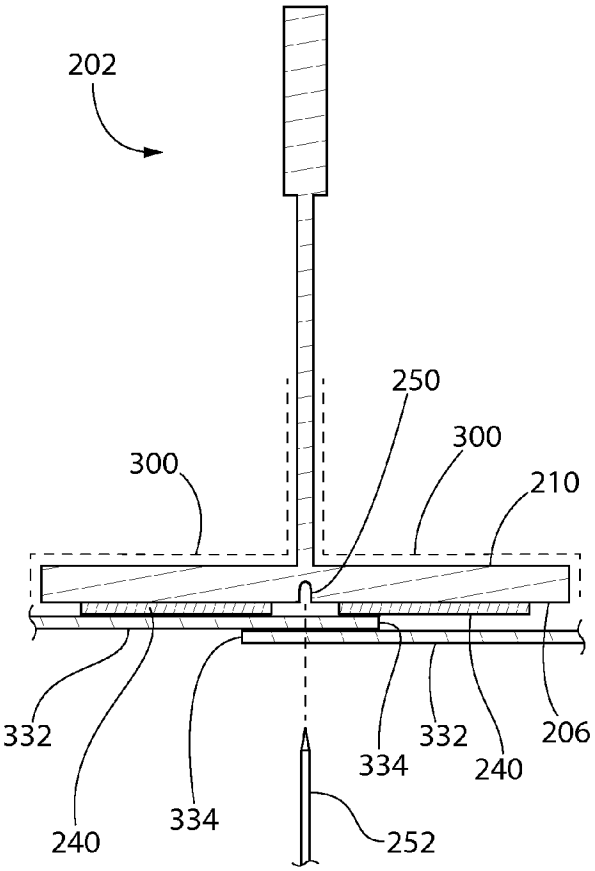

The next step in the ceiling panel installation process to conceal the grid support member 202 is cutting and trimming the overlapped peripheral edges portions of the first and second ceiling panels 300 using the cutting guide groove 250 to form a tight and neat seam therebetween. Referring to FIG. 8, a cutting tool such as a razor knife may be used for trimming the overlapping bottom facing sheets 330. The tip of the blade 252 may be first placed at least partially into the groove 250 near one end of the overlapped peripheral edge portions 332 at a first axial position. The blade 252 may then be run or slid along the length of the cutting guide groove 250 and longitudinal axis LA to a second spaced apart axial position towards the opposite end of the overlapped bottom facings peripheral edge portions 332. Using the cutting guide groove, a straight linear cut through the edge portions 332 can be made, thereby trimming or cutting the overlapped peripheral edge portions 332 off to form a straight seam therebetween as shown in FIG. 9. The peripheral edge portion 332 of the second ceiling panel 300 may then be pressed firmly upwards against the remaining adhesive strip 240 to complete the installation. The peripheral edge portions 332 of the first and second ceiling panels 300 are now each adhesively bonded to the bottom surface 206 of the grid support member 202. Advantageously, the combination of straight-cut adjoining bottom facing edges 334 between adjacent ceiling panels 300 and adhesive bonding of their respective bottom facing sheets to the grid support member 202 contribute to creating a neat, tight abutment seam.

It will be appreciated that numerous variations in the foregoing ceiling panel installation process and sequence are possible.

While the foregoing description and drawings represent exemplary embodiments of the present disclosure, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes described herein may be made within the scope of the present disclosure. One skilled in the art will further appreciate that the embodiments may be used with many modifications of structure, arrangement, proportions, sizes, materials, and components and otherwise, used in the practice of the disclosure, which are particularly adapted to specific environments and operative requirements without departing from the principles described herein. The presently disclosed embodiments are therefore to be considered in all respects as illustrative and not restrictive. The appended claims should be construed broadly, to include other variants and embodiments of the disclosure, which may be made by those skilled in the art without departing from the scope and range of equivalents.

The invention claimed is:

1. A ceiling system comprising:

a longitudinally extending grid support member including a longitudinal axis, a flat horizontal bottom flange defining a bottom surface lying in a single horizontal plane, an opposing top surface parallel to the bottom surface and having a vertical thickness defined between the surfaces, and a vertical web extending upwards from the flange;

the vertical web comprising a unitary monolithic structure;

the bottom flange lying comprising a unitary monolithic structure which extends horizontally continuously in a transverse direction from a first longitudinal edge to an opposing second longitudinal edge;

a ceiling panel supported by the grid support member;

a first facing sheet attached to a bottom surface of the ceiling panel and having a peripheral edge portion attached to the grid support member; and an integral cutting guide groove formed in the bottom surface of the grid support member, the groove extending linearly along the longitudinal axis and having a depth penetrating the bottom flange less than the thickness of the bottom flange;

wherein the peripheral edge portion of first facing sheet includes an edge which is axially aligned with the groove.

2. The ceiling system according to claim 1, wherein the first facing sheet is adhesively coupled to the grid support member.

3. The ceiling system according to claim 2, further comprising double-sided adhesive strips which adhesively couple the first facing sheet to the grid support member.

4. The ceiling system according to claim 1, wherein the ceiling panel has a honeycomb core structure.

5. The ceiling system according to claim 1, wherein the first facing sheet is attached to a spacer panel disposed between the bottom surface of the ceiling panel and the first facing sheet.

6. The ceiling system according to claim 5, wherein the spacer panel has a bottom surface located substantially flush with the bottom surface of the grid support member.

7. The ceiling system according to claim 1, wherein the grid support member is T-shaped.

8. The ceiling system according to claim 1, wherein the ceiling panel is a tegular panel having a stepped side edge profile.

9. The ceiling system according to claim 1, further comprising a second facing sheet of a second ceiling panel supported by the grid support member, the second facing sheet having an edge which is axially aligned with the groove and disposed adjacent the edge of the first facing sheet.

10. A ceiling system comprising:

a first grid support member and second grid support member spaced apart from the first grid support member;

each of the first and second grid support members including a longitudinal axis, a flat horizontal bottom flange defining a bottom surface lying in a single horizontal plane, an opposing top surface parallel to the bottom surface and having a vertical thickness defined between the surfaces, a vertical web extending upwards from the bottom flange, and an integral cutting guide groove formed in the bottom surface and extending linearly along the longitudinal axis, the groove having a depth penetrating the bottom flange less than the thickness of the bottom flange;

the vertical web of each grid support member comprising a unitary monolithic structure;

the bottom flange of each grid support member comprising a unitary monolithic structure which extends horizontally continuously in a transverse direction from a first longitudinal edge to an opposing second longitudinal edge;

a ceiling panel extending between the first and second grid support members, the ceiling panel supported by the first and second grid support members; and a first facing sheet attached to a bottom surface of the ceiling panel and attached to the first and second grid support members;

wherein the first facing sheet includes a first edge which is axially aligned with the groove of the first grid support member and an opposing second edge which is axially aligned with the groove of the second grid support member.

11. The ceiling system according to claim 10, further comprising a second facing sheet having an edge axially aligned with the groove of the first grid support member and disposed adjacent to the first edge of the first facing sheet.

12. The ceiling system according to claim 10, wherein the first facing sheet is adhesively coupled to each grid support member.

13. The ceiling system according to claim 12, further comprising double-sided adhesive strips which adhesively couple the first facing sheet to each grid support member.

14. The ceiling system according to claim 10, wherein the ceiling panel has a honeycomb core structure.

15. The ceiling system according to claim 10, wherein the first facing sheet is attached to a spacer panel disposed between a bottom surface of the ceiling panel and the first facing sheet.

16. The ceiling system according to claim 10, wherein each grid support member is T-shaped.

17. The ceiling system according to claim 10, wherein the ceiling panel is a tegular panel having a stepped side edge profile.

18. A ceiling system comprising:

a first grid support member and second grid support member spaced apart from the first grid support member;

each of the first and second grid support members including a longitudinal axis, a flat horizontal bottom flange defining a bottom surface lying in a single horizontal plane, an opposing top surface parallel to the bottom surface and having a vertical thickness defined between the surfaces, a vertical web extending upwards from the bottom flange, and an integral cutting guide groove formed in the bottom surface and extending linearly along the longitudinal axis;

the vertical web of each grid support member comprising a unitary monolithic structure;

the bottom flange of each grid support member comprising a single unitary monolithic structure which extends horizontally continuously in a direction transverse from a first longitudinal edge to an opposing second longitudinal edge;

a ceiling panel extending between the first and second grid support members, the ceiling panel comprising a honeycomb core and supported by the first and second grid support members; and a bottom facing sheet attached to a bottom of the honeycomb core of the ceiling panel and further directly attached to the bottom surfaces of the first and second grid support members;

wherein the bottom facing sheet includes a first edge which is axially aligned with the groove of the first grid support member and an opposing second edge which is axially aligned with the groove of the second grid support member; and wherein the bottom facing sheet is in a vertical position that is substantially flush with the bottom surfaces of the bottom flanges of the grid support members.

* * * * *